US011524808B2

(12) United States Patent
Nishitsuji et al.

(10) Patent No.: US 11,524,808 B2
(45) Date of Patent: Dec. 13, 2022

(54) BOX PACKING APPARATUS

(71) Applicant: ISHIDA CO., LTD., Kyoto (JP)

(72) Inventors: Satoshi Nishitsuji, Ritto (JP); Kousuke Watanabe, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 16/638,470

(22) PCT Filed: Jul. 25, 2018

(86) PCT No.: PCT/JP2018/027790
§ 371 (c)(1),
(2) Date: Feb. 12, 2020

(87) PCT Pub. No.: WO2019/035325
PCT Pub. Date: Feb. 21, 2019

(65) Prior Publication Data

US 2020/0361650 A1 Nov. 19, 2020

(30) Foreign Application Priority Data

Aug. 16, 2017 (JP) ..... JP2017-157065

(51) Int. Cl.
*B65B 57/14* (2006.01)
*B65B 5/06* (2006.01)
(Continued)

(52) U.S. Cl.
CPC ..... *B65B 57/14* (2013.01); *B65B 5/061* (2013.01); *B65B 5/105* (2013.01); *B65B 35/38* (2013.01); *B65B 35/50* (2013.01); *B65B 35/58* (2013.01)

(58) Field of Classification Search
CPC ..... B65B 57/14; B65B 5/105; B65B 5/061; B65B 35/50; B65B 35/38; B65B 35/58; B65B 59/001
See application file for complete search history.

(56) References Cited

U.S. PATENT DOCUMENTS 4,800,703 A * 1/1989 Goodman ..... B65B 5/08 53/244
5,046,303 A * 9/1991 Becicka ..... B65B 11/045 53/540
(Continued)

FOREIGN PATENT DOCUMENTS

EP 0398726 A1 11/1990
GB 2102758 A * 2/1983 ..... B65B 57/14
(Continued)

OTHER PUBLICATIONS

The Search Report from the corresponding European Patent Application No. 18846610.6 dated Jul. 3, 2020.
(Continued)

*Primary Examiner* — Thomas M Wittenschlaeger
(74) *Attorney, Agent, or Firm* — Shinjyu Global IP

(57) ABSTRACT

A box packing apparatus has an accumulating mechanism, a detection unit, and a packing mechanism. The accumulating mechanism is configured to accumulate a plurality of articles to create an article group. The detection unit is configured to detect a posture of the article group. The packing mechanism is configured to pack the article group into a packing box based on a detection result of the detection unit.

12 Claims, 13 Drawing Sheets

(51) Int. Cl.

| | |
|---|---|
| ***B65B 5/10*** | (2006.01) |
| ***B65B 35/38*** | (2006.01) |
| ***B65B 35/50*** | (2006.01) |
| ***B65B 35/58*** | (2006.01) |

(56) References Cited

U.S. PATENT DOCUMENTS 5,121,589 A * 6/1992 Ventura ..... B65B 25/04 53/240
5,251,422 A * 10/1993 Goodman ..... B65B 5/061 53/251
5,605,031 A * 2/1997 Prakken ..... B65B 5/105 53/537
5,661,949 A * 9/1997 Blanc ..... B65B 25/046 53/154
5,778,640 A * 7/1998 Prakken ..... B65B 5/061 53/244
5,829,222 A * 11/1998 Schlagel ..... B65B 25/008 53/54
5,881,532 A * 3/1999 Kitagawa ..... B65G 47/082 53/54
6,711,880 B2 * 3/2004 Wipf ..... B65B 9/06 53/203
6,878,222 B1 * 4/2005 Os ..... B65B 59/003 156/64
7,293,591 B2 * 11/2007 Nakagawa ..... B65B 15/04 156/362
8,671,651 B2 * 3/2014 Poutot ..... B65B 43/285 53/398
8,880,216 B2 * 11/2014 Izumi ..... G05B 19/4182 700/228
8,899,001 B2 * 12/2014 Bachelle ..... B65B 35/44 53/398
8,938,934 B2 * 1/2015 Brunson ..... B65B 11/02 53/139.7
8,997,438 B1 * 4/2015 Fallas ..... B25J 9/107 53/251
9,272,421 B2 * 3/2016 Subotincic ..... B25J 15/0658
9,428,344 B2 * 8/2016 Di Donna ..... B65B 57/04
9,573,771 B2 * 2/2017 Papsdorf ..... B65G 47/53
9,764,909 B2 * 9/2017 Baumann ..... B65G 57/06
10,017,285 B2 * 7/2018 Boudreau ..... B25J 9/0051
2006/0048486 A1 * 3/2006 Laing ..... B65D 31/02 53/469
2008/0271417 A1 * 11/2008 Drost ..... B65B 5/103 53/443
2011/0064553 A1 * 3/2011 Lanfranchi ..... B29C 49/4205 414/730
2016/0039550 A1 * 2/2016 Boudreau ..... B65B 35/36 53/446
2017/0203861 A1 * 7/2017 Van Halsema ..... B65B 5/08
2017/0203865 A1 * 7/2017 Kalany ..... B25J 9/0093
2019/0351563 A1 * 11/2019 Bando ..... B65G 47/907

FOREIGN PATENT DOCUMENTS

JP H2-152605 A 6/1990
JP H4-31202 A 2/1992
JP H10-291503 A 11/1998
JP H11-70901 A 3/1999
JP 2005-314006 A 11/2005
JP 2016-13867 A 1/2016
JP 2017-88183 A 5/2017

OTHER PUBLICATIONS

The Search Report from the corresponding International Patent Application No. PCT/JP2018/027790 dated Sep. 18, 2018.
The Preliminary Report on Patentability (with Written Opinion) from the corresponding International Patent Application No. PCT/JP2018/027790 dated Feb. 18, 2020.
The Office Action from the corresponding Japanese Patent Application No. 2019-536715 dated Sep. 13, 2022.

* cited by examiner

BOX PACKING APPARATUS

CROSS-REFERENCE TO RELATED APPLICATIONS

This application is the U.S. National Phase of International Application No. PCT/JP2018/027790, filed Jul. 25, 2018. That application claims priority to Japanese Patent Application No. 2017-157065, filed Aug. 16, 2017. Both of those applications are incorporated by reference herein in their entireties.

TECHNICAL FIELD

The present invention relates to a box packing apparatus.

BACKGROUND ART

In the process of manufacturing articles such as bag packed potato chips, a predetermined number of the articles are packed into a packing box by a box packing apparatus such as the one disclosed in Japanese Patent Application Publication No. 2016-13867. The box packing apparatus first accumulates a plurality of the articles to create an article group corresponding to one tier's worth. Next, the box packing apparatus packs the article group into the packing box. The box packing apparatus repeats this operation a number of times equal to the number of tiers of the articles to be put inside one packing box to thereby pack the predetermined number of the articles into the packing box.

BRIEF SUMMARY

In a case where the accumulation of one tier's worth of the articles has not been properly performed, undesired phenomena such as bag bursting or article loss can occur in the process of packing the article group into the packing box. In this case, there is the concern that a packing box that does not satisfy the quantity of articles to be packed will be shipped.

It is an object of the present invention to prevent damage to and/or loss of articles in a box packing apparatus and to pack the normal number of the articles into a packing box.

A box packing apparatus pertaining to a first aspect of the invention has an accumulating mechanism, a detection unit, and a packing mechanism. The accumulating mechanism accumulates a plurality of articles to create an article group. The detection unit detects the posture of the article group. The packing mechanism packs the article group into a packing box on the basis of the detection result of the detection unit.

According to this configuration, the packing of the article group into the packing box is performed on the basis of the detection result. Consequently, by not performing the packing when the detection result is abnormal, damage to and/or loss of the articles can be inhibited.

A box packing apparatus pertaining to a second aspect of the invention is the box packing apparatus pertaining to the first aspect, and further has an article group placement unit. The accumulating mechanism creates the article group on the article group placement unit. The detection unit detects the posture of the article group that has been created on the article group placement unit.

According to this configuration, the detection result relates to the posture of the article group on the article group placement unit. Consequently, an abnormality in the posture of the article group before the article group is gripped by the packing mechanism can be detected.

A box packing apparatus pertaining to a third aspect of the invention is the box packing apparatus pertaining to the first aspect or the second aspect, wherein the packing mechanism has a gripping unit that grips en bloc the article group. The detection unit detects the posture of the article group being gripped by the gripping unit.

According to this configuration, the detection result relates to the posture of the article group being gripped by the gripping unit. Consequently, an abnormality in posture that has arisen during the gripping can be detected.

A box packing apparatus pertaining to a fourth aspect of the invention is the box packing apparatus pertaining to any one of the first aspect to the third aspect, wherein the detection unit detects the posture of the article group after the article group has undergone packing into the packing box by the packing mechanism.

According to this configuration, the detection result relates to the posture of the article group that has undergone packing. Consequently, damage to and/or loss of the articles that has arisen during the packing can be detected.

A box packing apparatus pertaining to a fifth aspect of the invention is the box packing apparatus pertaining to any one of the first aspect to the fourth aspect, wherein the detection unit has a camera.

According to this configuration, the detection unit has a camera. Consequently, a lot of information relating to the posture of the article group can be acquired.

A box packing apparatus pertaining to a sixth aspect of the invention is the box packing apparatus pertaining to any one of the first aspect to the fifth aspect, wherein the detection unit has a photosensor.

According to this configuration, the detection unit has a photosensor. Consequently, the detection unit is configured inexpensively.

A box packing apparatus pertaining to a seventh aspect of the invention is the box packing apparatus pertaining to the third aspect, wherein the detection unit has a photosensor provided in the gripping unit.

According to this configuration, the detection unit has a photosensor provided in the gripping unit. Consequently, loss or the like of the articles gripped by the gripping unit is detected.

A box packing apparatus pertaining to an eighth aspect of the invention is the box packing apparatus pertaining to the third aspect, and further has a box retention unit that retains at least part of the packing box. The detection unit has photosensors provided in the box retention unit.

According to this configuration, the detection unit has photosensors provided in the box support unit. Consequently, an article group with a posture that will not fit into the packing box is detected.

A box packing apparatus pertaining to a ninth aspect of the invention is the box packing apparatus pertaining to any one of the first aspect to the eighth aspect, and further has a determination unit that determines the detection result. In a case where the determination unit has determined that the posture of the article group pertaining to the detection result is abnormal, the packing mechanism discharges the article group without packing it into the packing box.

According to this configuration, the packing mechanism discharges the article group on the basis of an abnormal determination by the determination unit. Consequently, an article group with an abnormality in its posture is not packed into the packing box.

A box packing apparatus pertaining to a tenth aspect of the invention is the box packing apparatus pertaining to any one of the first aspect to the ninth aspect, wherein the articles configuring the article group each partially overlap other articles.

According to this configuration, the article group comprises a plurality of articles that partially overlap each other. Consequently, an abnormality in posture can be detected in regard to an article group in which it is easy for bag bursting or loss of the articles to occur in the packing of the article group into the packing box.

A box packing apparatus pertaining to an eleventh aspect of the invention is the box packing apparatus pertaining to the first aspect, wherein the accumulating mechanism creates the article group by gripping the plurality of articles.

According to this configuration, the accumulating mechanism simultaneously grips the plurality of articles. Consequently, the article group is quickly created.

A box packing apparatus pertaining to a twelfth aspect of the invention is the box packing apparatus pertaining to the eleventh aspect, wherein the accumulating mechanism has a suction head for gripping the article group.

According to this configuration, the articles are gripped by the suction head as a result of being sucked by the suction head. Consequently, it is easy to grip and release the articles.

A box packing apparatus pertaining to a thirteenth aspect of the invention is the box packing apparatus pertaining to the eleventh aspect or the twelfth aspect, wherein the detection unit is installed in the accumulating mechanism and detects the posture of the article group being gripped by the accumulating mechanism.

According to this configuration, the posture of the article group gripped by the accumulating mechanism is detected by the detection unit installed in the accumulating mechanism. Consequently, the detection of the posture of the article group is performed quickly.

A box packing apparatus pertaining to a fourteenth aspect of the invention is the box packing apparatus pertaining to any one of eleventh aspect to the thirteenth aspect, wherein the accumulating mechanism and the packing mechanism are configured by the same robot.

According to this configuration, the accumulating mechanism and the packing mechanism are the same robot. Consequently, the number of parts configuring the box packing apparatus is few.

A box packing apparatus pertaining to a fifteenth aspect of the invention is the box packing apparatus pertaining to the fourteenth aspect, and further has a determination unit that determines the detection result. In a case where the determination unit has determined that the posture of the article group pertaining to the detection result is abnormal, the packing mechanism discharges the article group without packing it into the packing box.

According to this configuration, the packing mechanism discharges the article group on the basis of an abnormal determination by the determination unit. Consequently, an article group with an abnormality in its posture is not packed into the packing box.

According to the box packing apparatus pertaining to the invention, damage to and/or loss of articles can be inhibited.

DETAILED DESCRIPTION

First Embodiment

(1) Target Handled by Box Packing Apparatus

Figure 1:
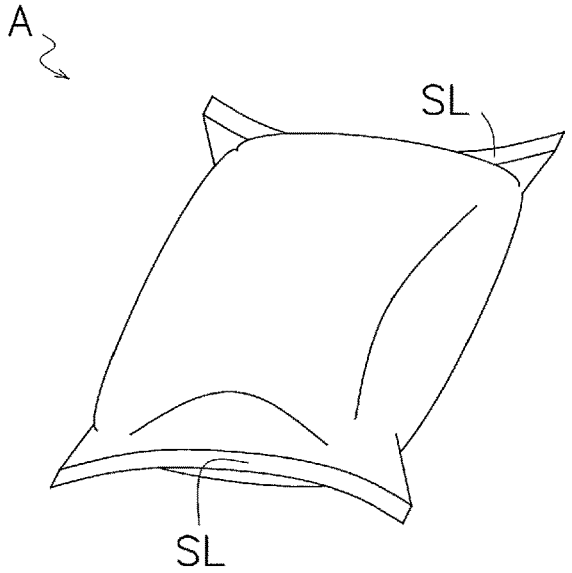
FIG. 1 is a schematic view of an article A.
Figure 2:
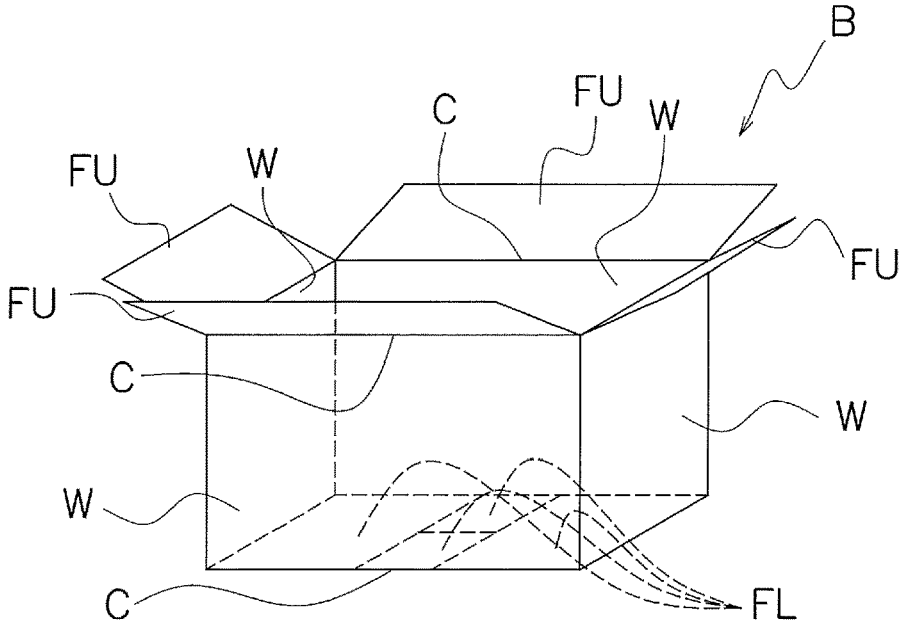
FIG. 2 is a schematic view of a packing box B.

Box packing apparatus pertaining to the invention pack a plurality of articles A shown in FIG. 1 into a packing box B shown in FIG. 2.

(1-1) Article A

FIG. 1 is an outer view of the article A handled by the box packing apparatus. The article A comprises contents such as potato chips or another food product, for example, packaged in a bag using film. Seal portions SL are formed in the top edge and the bottom edge of the article A.

(1-2) Packing Box B

FIG. 2 is an outer view of the packing box B. The packing box B comprises corrugated cardboard, for example. The packing box B has four wall portions W and upper flaps FU and lower flaps FL that extend from the wall portions W. The upper flaps FU and the lower flaps FL can be folded with respect to the wall portions W at the locations of creases C.

In the packing box B shown in this drawing, the lower flaps FL have been folded to configure a bottom of the packing box B. The upper flaps FU are open.

(2) Overall Configuration of Box Packing Apparatus 90

Figure 3:
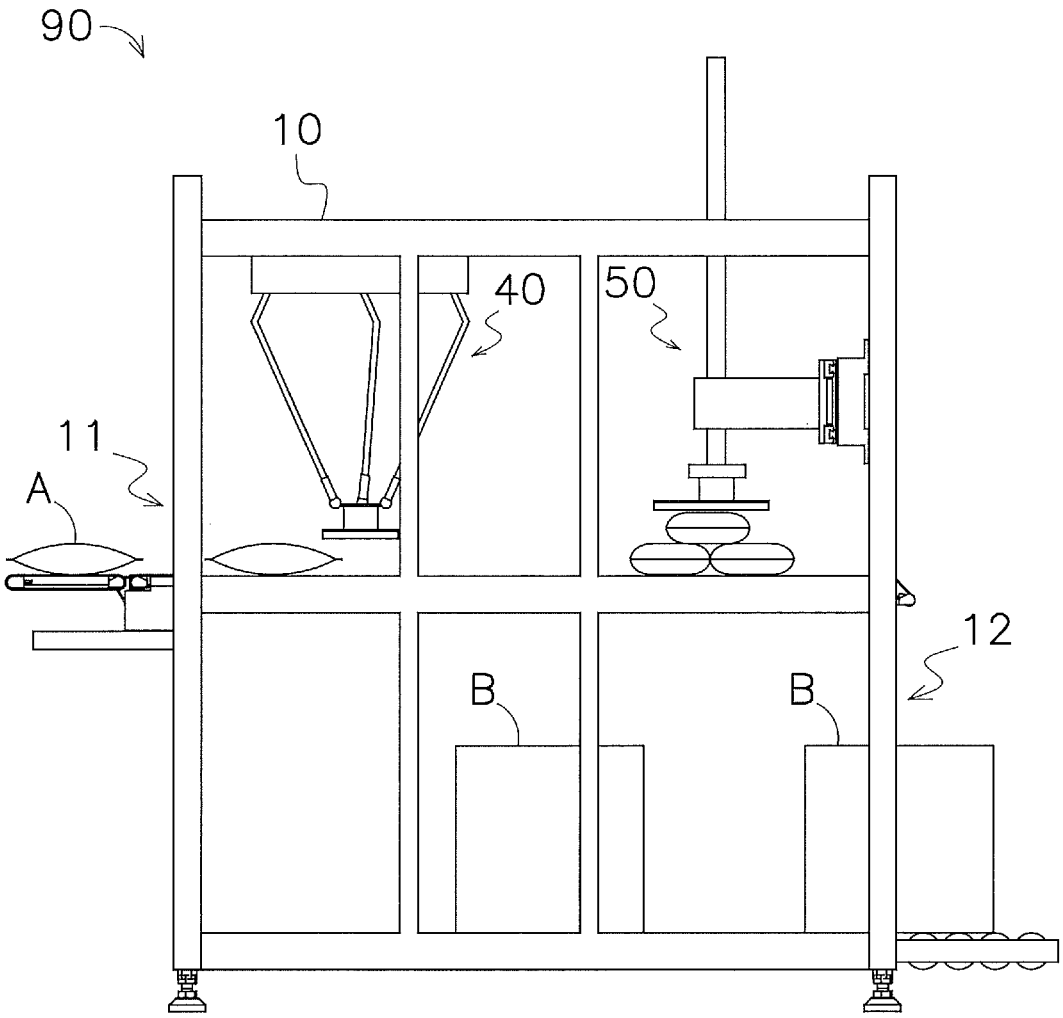
FIG. 3 is a side view of a box packing apparatus 90 pertaining to a first embodiment of the invention.
Figure 4:
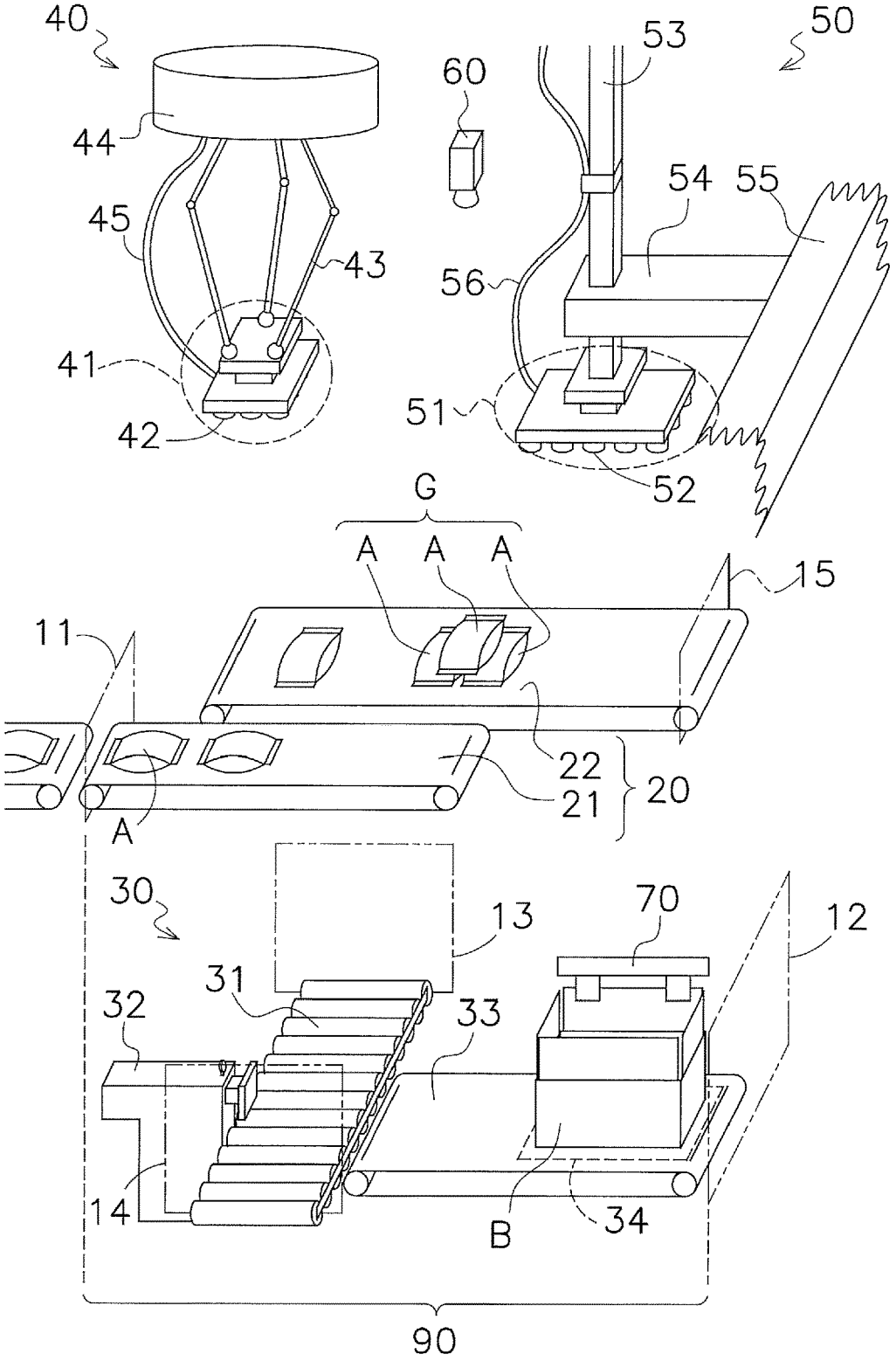
FIG. 4 is a schematic view of the internal configuration of the box packing apparatus 90.

FIG. 3 shows an outer view of a box packing apparatus 90 pertaining to a first embodiment of the invention. The box packing apparatus 90 has a frame 10. FIG. 4 shows the internal configuration of the box packing apparatus 90. The box packing apparatus 90 further has an article conveyance unit 20, a box conveyance unit 30, an accumulating mechanism 40, a packing mechanism 50, a detection unit 60, and a box retention unit 70. Moreover, the box packing apparatus 90 has a control unit 80 shown in FIG. 5.

(3) Detailed Configuration (3-1) Frame 10

As shown in FIG. 3, the frame 10 supports parts of the box packing apparatus 90. As shown in FIG. 4, the frame 10 is provided with an inlet area 11, an outlet area 12, a first empty box inlet area 13, a second empty box inlet area 14, and a discharge area 15. The inlet area 11 is an area for taking in the articles A. The outlet area 12 is an area for discharging the packing boxes B that have finished having the plurality of articles A put into them. The first empty box inlet area 13 and the second empty box inlet area 14 are areas for taking in empty packing boxes B. The discharge area 15 is an area for discharging articles A whose state of accumulation is improper.

(3-2) Article Conveyance Unit 20

The article conveyance unit 20 of FIG. 4 conveys the articles A. The article conveyance unit 20 has a first conveyor 21 and a second conveyor 22. The first conveyor 21 is for taking in the articles A located in the inlet area 11 and comprises a belt conveyor, for example. The second conveyor 22 contributes to the accumulation of the plurality of articles A and comprises a belt conveyor, for example. The first conveyor 21 and the second conveyor 22 are disposed partially parallel to each other.

(3-3) Box Conveyance Unit 30

The box conveyance unit 30 conveys the packing boxes B. The box conveyance unit 30 has conveyor rollers 31, a box pushing mechanism 32, and a third conveyor 33. Empty packing boxes B are input from the first empty box inlet area 13 or the second empty box inlet area 14 in a state in which their upper flaps FU are open. The conveyor rollers 31 guide the empty packing boxes B to the box pushing mechanism 32. When the box pushing mechanism 32 detects an empty packing box B, it pushes the packing box B toward the third conveyor 33. The third conveyor 33 contributes to the packing of the articles A into the packing boxes B and comprises a belt conveyor, for example. Part of the upper surface of the third conveyor 33 configures a packing station 34, regardless of the state of rotation of the third conveyor.

(3-4) Accumulating Mechanism 40

The accumulating mechanism 40 accumulates a plurality of the articles A to create an article group G Specifically, the accumulating mechanism 40 lifts up the articles A carried by the first conveyor 21 and places them on the second conveyor 22 to thereby place the article group G on the second conveyor. The articles A configuring the article group G each partially overlap other articles A.

The accumulating mechanism 40 comprises a parallel link robot, for example, and has a head 41, three arms 43, a case 44, and a hose 45, for example. The head 41 has contactors 42. The contactors 42 are formed of a flexible or elastic material. The accumulating mechanism 40 controls a non-illustrated pump connected to the hose 45 to suck air through the contactors 42 of the head 41. Because of this suction, the head 41 can grip the article A contacting the contactors 42.

The case 44 houses plural motors not shown in the drawings. Some of the plural motors can also be provided in the head 41. The accumulating mechanism 40 uses the motors to drive the three arms 43 to thereby three-dimensionally move or rotate the head 41.

(3-5) Packing Mechanism 50

The packing mechanism 50 grips en bloc the article group G placed on the second conveyor 22 and moves it into the packing box B placed in the packing station 34. The packing mechanism 50 comprises a translating robot, for example, and has a head 51, a rod 53, a vertical moving device 54, a horizontal moving device 55, and a hose 56, for example. The head 51 has contactors 52. The contactors 52 are formed of a flexible or elastic material.

The packing mechanism 50 uses a non-illustrated pump connected to the hose 56 to suck air through the contactors 52 of the head 51. Because of this suction, the head 51 can grip en bloc the article group G contacting the contactors 52.

The vertical moving device 54 and the horizontal moving device 55 are driven by plural motors not shown in the drawings. The vertical moving device 54 can move the rod 53 connected to the head 51 in the up and down direction. The horizontal moving device 55 can move the vertical moving device 54 together with the head 51 in the horizontal direction.

(3-6) Detection Unit 60

The detection unit 60 detects the state of accumulation—that is, the posture—of the article group G The detection unit 60 comprises a camera. The detection unit 60 captures an image of the article group G placed on the second conveyor 22.

(3-7) Box Retention Unit 70

The box retention unit 70 retains, in regard to a packing box B placed in the packing station 34, the upper flaps FU to stabilize the state in which the upper flaps FU are open.

(3-8) Control Unit 80

Figure 5:
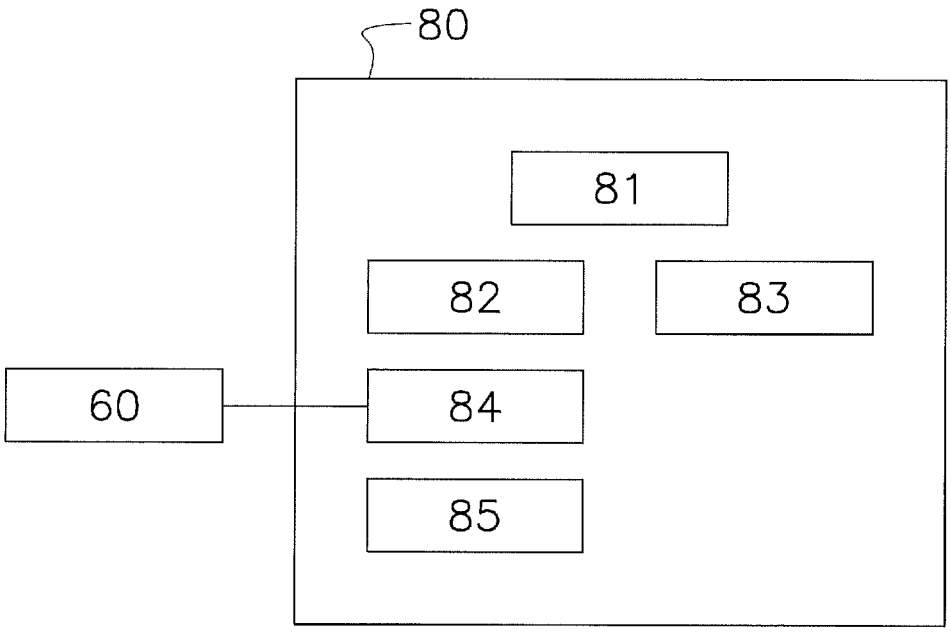
FIG. 5 is a schematic view of the configuration of a control unit 80.

As shown in FIG. 5, the control unit 80 has a central processing unit 81, a sensor reading unit 82, an actuator driving unit 83, a signal processing unit 84, and a determination unit 85. The control unit 80 can also be configured overall by a CPU and a memory storing programs so that it can exercise the functions of these blocks.

The central processing unit 81 is in charge of the overall operation of the box packing apparatus 90. The sensor reading unit 82 reads the output of various sensors. The actuator driving unit 83 outputs signals that drive various actuators. The various actuators are motors for driving the belt conveyors, for example. The signal processing unit 84 processes output signals of the detection unit 60. The output signals specifically are image signals of the camera. The determination unit 85 receives the processing result of the signal processing unit 84 and determines whether the posture of the article group G is normal or abnormal.

(4) Overall Operation

As shown in FIG. 4, an empty packing box B is input from the first empty box inlet area 13 or the second empty box inlet area 14. The box conveyance unit 30 conveys the empty packing box B to the packing station 34. The empty packing box B stands by in the packing station 34.

The box packing apparatus 90 receives one at a time the articles A in the inlet area 11. The first conveyor 21 conveys the articles A. The two seal portions SL (see FIG. 1) of the articles A placed on the first conveyor 21 are spaced apart from each other in the conveyance direction. Ordinarily, conveyance by the first conveyor 21 is performed at a fixed speed, but in a case where, for example, a delay has been detected in the process of a downstream mechanism, the first conveyor 21 can also temporarily halt conveyance.

Figure 6:
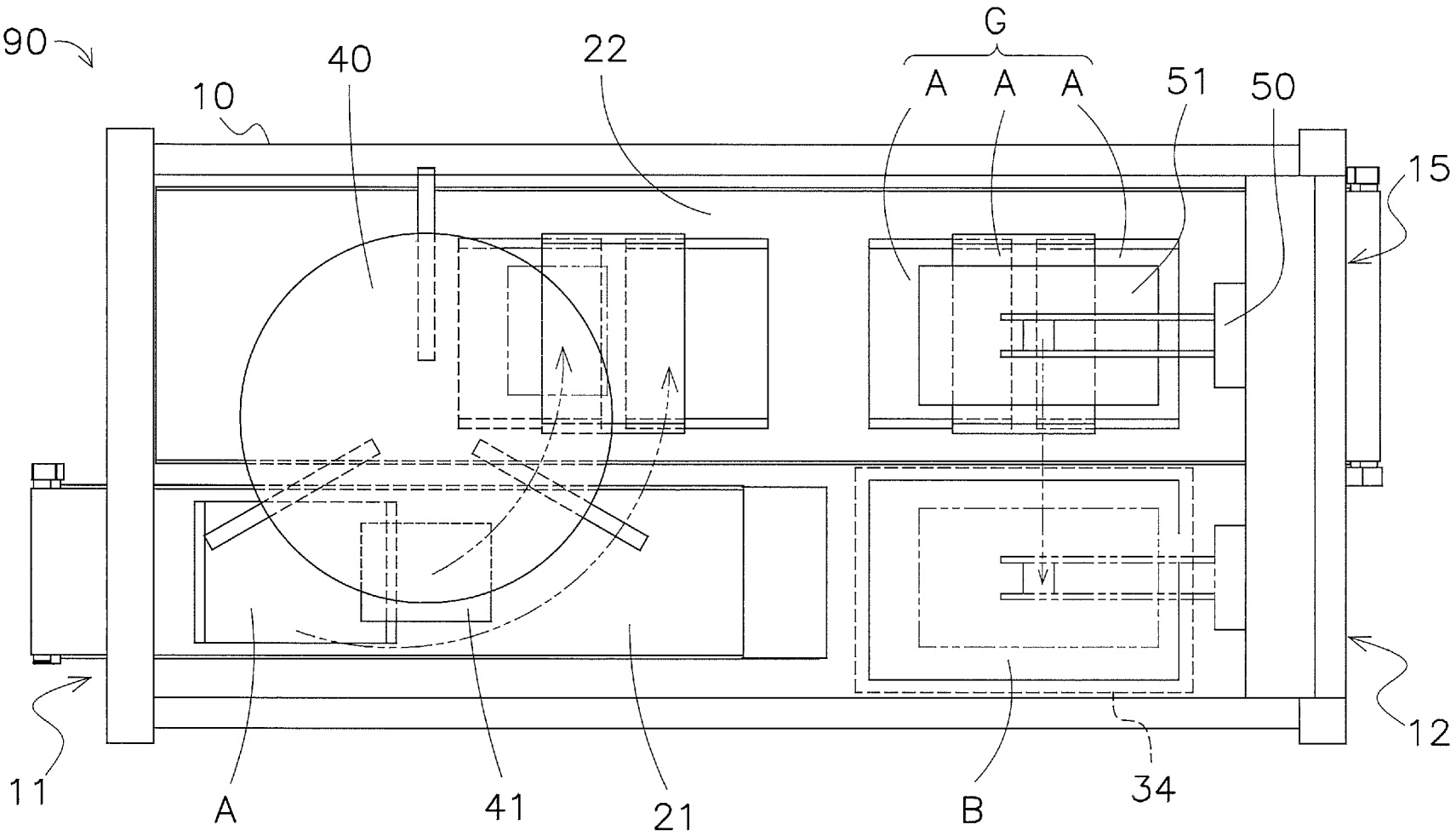
FIG. 6 is a plan view of the box packing apparatus 90.

The accumulating mechanism 40 first moves a first article A from the first conveyor 21 to the second conveyor 22. In the process of this movement, as shown in FIG. 6, the accumulating mechanism 40 rotates the head 41 by 90°. Because of this rotation, the accumulating mechanism 40 can place the article A on the second conveyor 22 in such a way that the two seal portions SL of the article A are spaced apart from each other in the direction orthogonal to the conveyance direction of the first conveyor 21. Next, the accumulating mechanism 40 rotates and moves a second article A in the same way and places it next to the first article A that is on the second conveyor 22. Finally, the accumulating mechanism 40 rotates and moves a third article A in the same way and stacks it on both the first article A and the second article A. In this way, the accumulating mechanism 40 creates the article group G.

The second conveyor 22 moves the article group G toward the packing mechanism 50.

The packing mechanism 50 moves the head 51 toward the article group G placed on the second conveyor 22 and brings the contactors 52 into contact with the article group G Then, the packing mechanism 50 grips en bloc the article group G and lifts up the article group G in the vertical direction. Thereafter, the packing mechanism 50 horizontally moves the article group G to the above of the packing box B standing by in the packing station 34. Next, the packing mechanism 50 lowers the article group G into the packing box B below it. Finally, the packing mechanism 50 stops the air suction and stops the gripping of the article group G.

The box packing apparatus 90 repeats this series of operations a predetermined number of times to thereby stack a predetermined number of tiers of the article groups G in the packing box B.

Finally, the third conveyor 33 discharges from the outlet area 12 the packing box B that has finished with the box packing process. After this, the upper flaps FU of the packing box B are folded by a worker or a machine, whereby the packing box B is closed.

(5) Detection of State of Accumulation (5-1) Improper State of Accumulation

Figure 7:
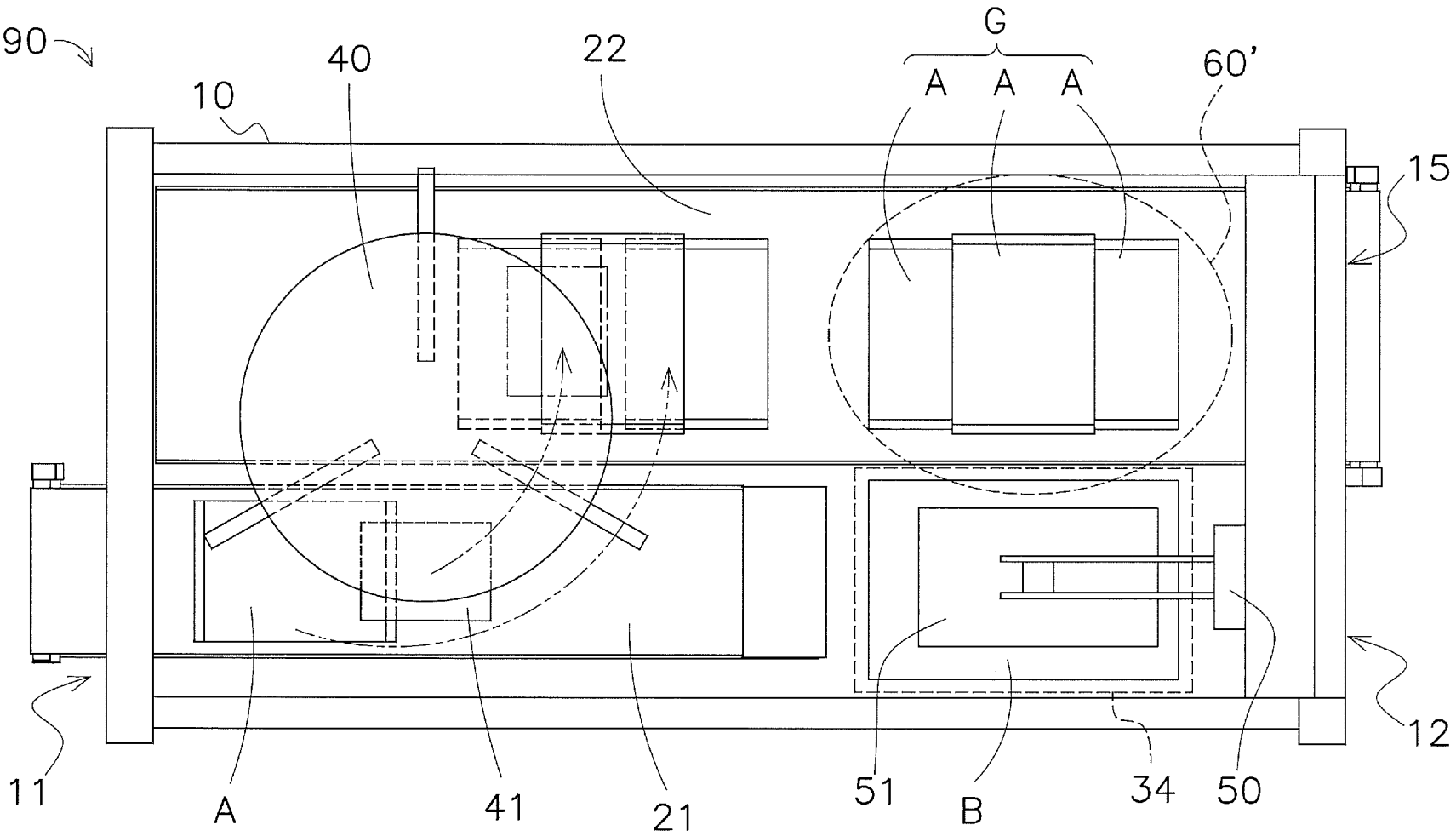
FIG. 7 is a plan view of the box packing apparatus 90.

In FIG. 7 is shown an article group G that has been properly accumulated. The article group G comprises three articles A that have been accumulated. In a case where the state of accumulation of the article group G is improper, the three articles A might be arranged more widely so that the article group G occupies a greater area. When the packing mechanism 50 packs an article group G with this kind of abnormal posture into the packing box B, there is the concern that some of the articles A that have made contact with the packing box B will fall outside the packing box B or that the bags of some of the articles A that have become sandwiched between the head 51 and the packing box B will burst.

An improper state of accumulation of the article group G can also cause the contact between some of the articles A and the contactors 52 to be insufficient. In this case, there is the concern that as the head 51 is gripping the article group G and moving the article group some of the articles A will fall from the head 51.

(5-2) Operation of Detection Unit 60

The detection unit 60 captures an image of an area including a target region 60' shown in FIG. 7. The target region 60' includes the article group G placed on the second conveyor 22. The image signals captured by the detection unit 60 are sent to the signal processing unit 84 of the control unit 80 of FIG. 5. The signal processing unit 84 performs image processing such as binarization and edge extraction on the image signals to thereby detect the shape of the area occupied by the article group G Next, the determination unit 85 compares the shape of the article group G to the size of the packing box B to determine whether the posture of the article group G is normal or abnormal. In a case where the determination unit 85 has determined that the posture of the article group G is abnormal, the actuator driving unit 83 drives the second conveyor 22 to discharge the abnormal article group G from the discharge area 15 to the outside of the box packing apparatus 90.

(6) Characteristics (6-1)

The packing of the article group G into the packing box B is performed on the basis of the detection result of the detection unit 60. Consequently, by not performing the packing when the detection result is abnormal, damage to and/or loss of the articles A can be inhibited.

(6-2)

The detection result relates to the posture of the article group G on the second conveyor 22. Consequently, an abnormality in the posture of the article group G before the article group G is gripped by the packing mechanism 50 can be detected.

(6-3)

The detection unit 60 has a camera. Consequently, a lot of information relating to the posture of the article group G can be acquired.

(6-4)

The packing mechanism 50 discharges the article group G on the basis of an abnormality determination by the determination unit 75. Consequently, an article group G with an abnormality in its posture is not packed into the packing box B.

(6-5)

The article group G comprises a plurality of articles A that partially overlap each other. Consequently, an abnormality in posture can be detected with regard to an article group G in which it is easy for bag bursting or loss of the articles A to occur in the packing the article group G into the packing box B.

(7) Example Modifications (7-1)

The arrangement of the articles A conveyed by the first conveyor 21 is not limited to a state in which the two seal portions SL are spaced apart from each other in the conveyance direction. For example, the two seal portions SL can also be spaced apart from each other in the direction orthogonal to the conveyance direction. Moreover, the arrangement of the articles A placed on the second conveyor 22 is not limited to a state in which the two seal portions SL are spaced apart from each other in the direction orthogonal to the conveyance direction. For example, the two seal portions SL can also be spaced apart from each other in the conveyance direction.

(7-2)

Figure 8A:
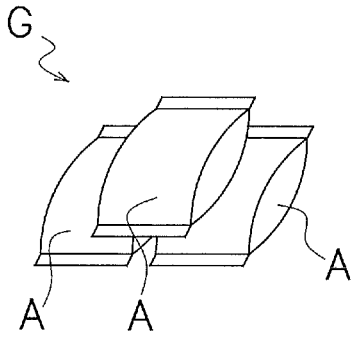
FIG. 8A is a schematic view showing an example of an article group G.
Figure 8B:
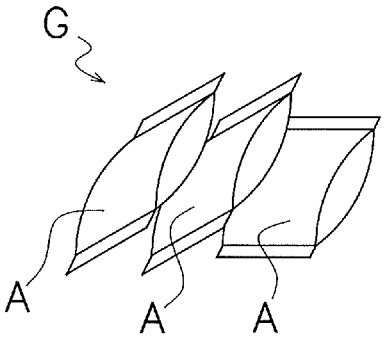
FIG. 8B is a schematic view showing an example of the article group G.
Figure 8C:
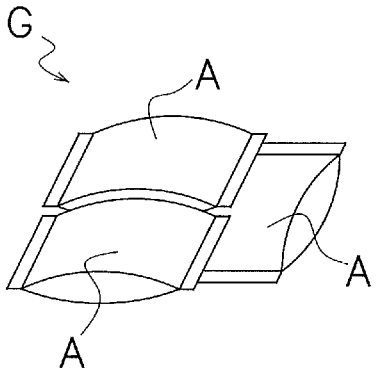
FIG. 8C is a schematic view showing an example of the article group G.
Figure 8D:
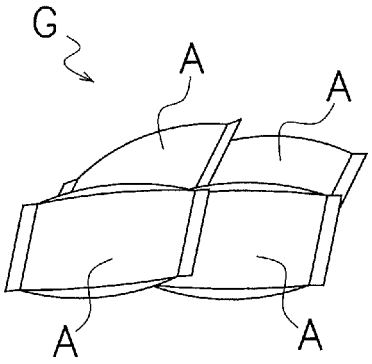
FIG. 8D is a schematic view showing an example of the article group G.

The configuration of the article group G employed in the above embodiment is one which comprises three articles A as shown in FIG. 8A and in which the middle article A is placed on top of the articles A on both sides. However, the configuration of the article group G is not limited to this. FIG. 8B to FIG. 8D show examples of other configurations of the article group G In the article group G shown in FIG. 8B, the article A on the left side out of the two articles A adjacent to each other is placed on top of the article A on the right side. The article group G shown in FIG. 8C comprises three articles A. Two of the articles A are arranged in the same direction, while one article A is arranged in a direction orthogonal to the other articles A. The article group G shown in FIG. 8D comprises four articles A. Each of the articles A overlaps any of the other articles A.

Moreover, the article group G can have all kinds of configurations other than these. For example, the articles A do not have invariably have to overlap other articles A in the article group G.

(7-3)

The articles A are not limited to articles in which the contents are packaged in bags. For example, the articles A can also be articles in which the contents are packaged in boxes smaller than the packing box B.

Second Embodiment

(1) Configuration

Figure 9:
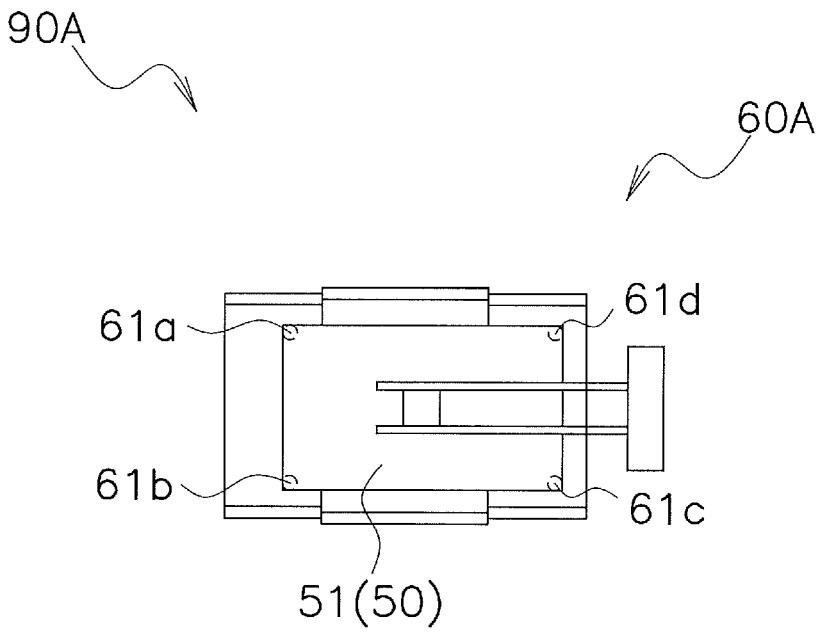
FIG. 9 is a plan view showing a detection unit 60A of a box packing apparatus 90A pertaining to a second embodiment of the invention.

FIG. 9 shows a detection unit 60A of a box packing apparatus 90A pertaining to a second embodiment of the invention. The box packing apparatus 90A differs from the box packing apparatus 90 pertaining to the first embodiment in that it has the detection unit 60A instead of the detection unit 60.

The detection unit 60A comprises photosensors 61*a* to 61*d*. The photosensors 61*a* to 61*d* are all reflective photosensors, that is, they have a light emitting component and a light receiving component. The light emitting component emits light toward a target object. The light can be infrared light or can be light having a wavelength other than this. The light reflects on the target object. The light receiving component detects the reflected light. The distance between the photosensors 61*a* to 61*d* and the target object is grasped by the level of the reflected light detected by the light receiving component.

The photosensors 61*a* to 61*d* are provided in the four corners of the head 51 of the packing mechanism 50. The light emitting components of the photosensors 61*a* to 61*d* emit the light downward. The light reflects on the article group G that is the target object. In a case where an article group G that has been properly accumulated is being gripped by the head 51, the distance between the photosensors 61*a* to 61*d* and the article group G is small, so the light receiving components can detect reflected light having a level equal to or greater than a predetermined threshold. In a case where the detection level of at least one of the photosensors 61*a* to 61*d* is less than the threshold, some of the articles A that should configure the article group G might not be properly gripped by the head 51, and the probability that they have been lost is high.

The signal processing unit 84 of FIG. 5 grasps the detection levels of the photosensors 61*a* to 61*d*. The determination unit 85 compares the detection levels of the photosensors 61*a* to 61*d* to the threshold and determines whether or not the article group G is being properly gripped by the head 51.

(2) Characteristics (2-1)

The detection result relates to the posture of the article group G being gripped by the head 51. Consequently, an abnormality in posture that has arisen during the gripping by the head 51 can be detected.

(2-2)

The detection unit 60A has the photosensors 61*a* to 61*d*. Consequently, the detection unit 60A is configured inexpensively.

(2-3)

The photosensors 61*a* to 61*d* of the detection unit 60A are provided in the head 51. Consequently, loss or the like of the articles A gripped by the head 51 is detected.

(3) Example Modifications

The example modifications of the first embodiment can also be applied to this embodiment.

Third Embodiment

(1) Configuration

Figure 10:
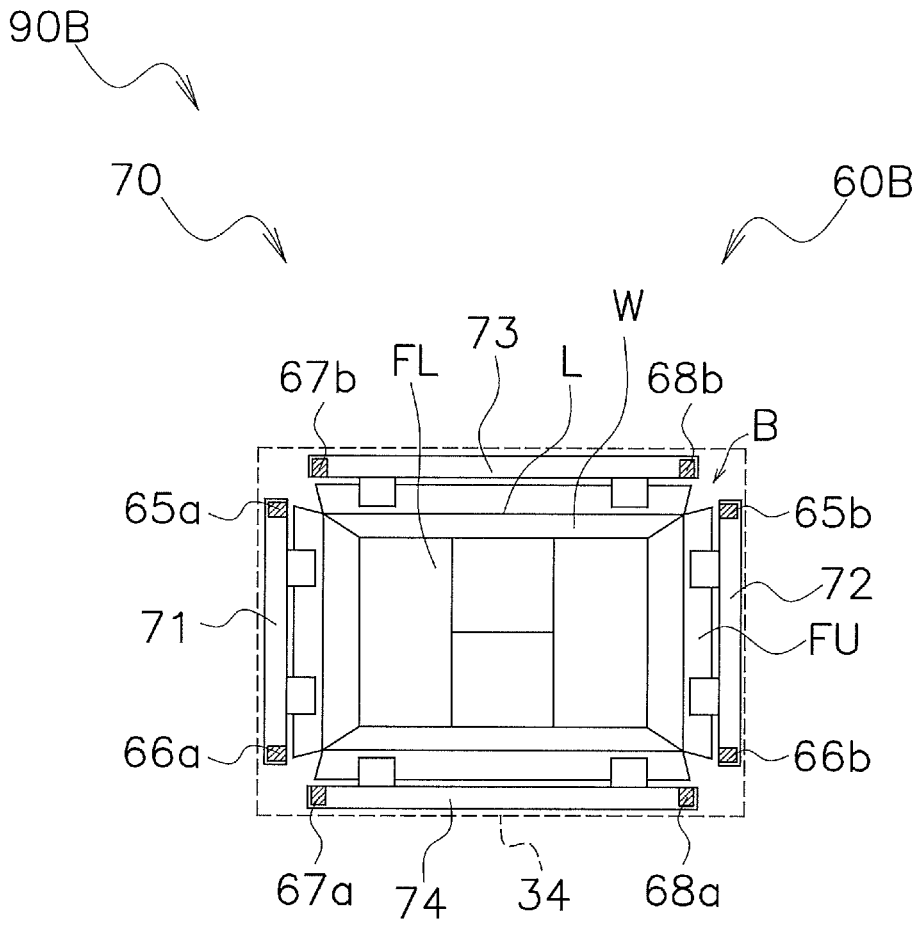
FIG. 10 is a plan view showing a detection unit 60B of a box packing apparatus 90B pertaining to a third embodiment of the invention.

FIG. 10 shows a detection unit 60B of a box packing apparatus 90B pertaining to a third embodiment of the invention. The box packing apparatus 90B differs from the box packing apparatus 90 pertaining to the first embodiment in that it has the detection unit 60B instead of the detection unit 60.

The detection unit 60B comprises photosensors 65*a*, 65*b*, 66*a*, 66*b*, 67*a*, 67*b*, 68*a*, 68*b*. These photosensors are transmissive photosensors and are four pairs of light emitters and light receivers. The photosensors 65*a*, 66*a*, 67*a*, 68*a* are light emitters and emit light. The light can be infrared light or can be light having a wavelength other than this. The photosensors 65*b*, 66*b*, 67*b*, 68*b* are light receivers. The light emitted by the photosensors 65*a*, 66*a*, 67*a*, 68*a* is detected by the photosensors 65*b*, 66*b*, 67*b*, 68*b*, respectively. When there is an obstacle between the light emitter and the light receiver, the light is blocked, so the detection level of the light receiver becomes lower.

The photosensors 65*a*, 65*b*, 66*a*, 66*b*, 67*a*, 67*b*, 68*a*, 68*b* are provided in the box retention unit 70. The box retention unit 70 retains the packing box B in a state in which the upper flaps FU of the packing box B placed in the packing station 34 are open. The box retention unit 70 has a first short-side flap retainer 71, a second short-side flap retainer 72, a first long-side flap retainer 73, and a second long-side flap retainer 74. The light emitted by the photosensors 65*a*, 66*a*, 67*a*, 68*a* proceeds along paths coinciding with or in proximity to the four creases C of the packing box B in plan view. When the packing mechanism 50 packs the article group G into the packing box B, if the posture of the article group G is normal, the article group G does not block the light emitted by the light emitters. If the posture of the article group G is abnormal, the article group G blocks the light emitted by the light emitters. In a case where the detection level of at least one of the photosensors 65*b*, 66*b*, 67*b*, 68*b* is less than a threshold, the probability that the article group G has an abnormal posture, such as sticking out from the creases C, is high.

(2) Characteristics

The photosensors of the detection unit 60B are provided in the box retention unit 70. Consequently, an article group G with a posture that will not fit into the packing box B is detected.

(3) Example Modifications

The example modifications of the embodiments up to now can also be applied to this embodiment.

Fourth Embodiment

(1) Configuration

Figure 11:
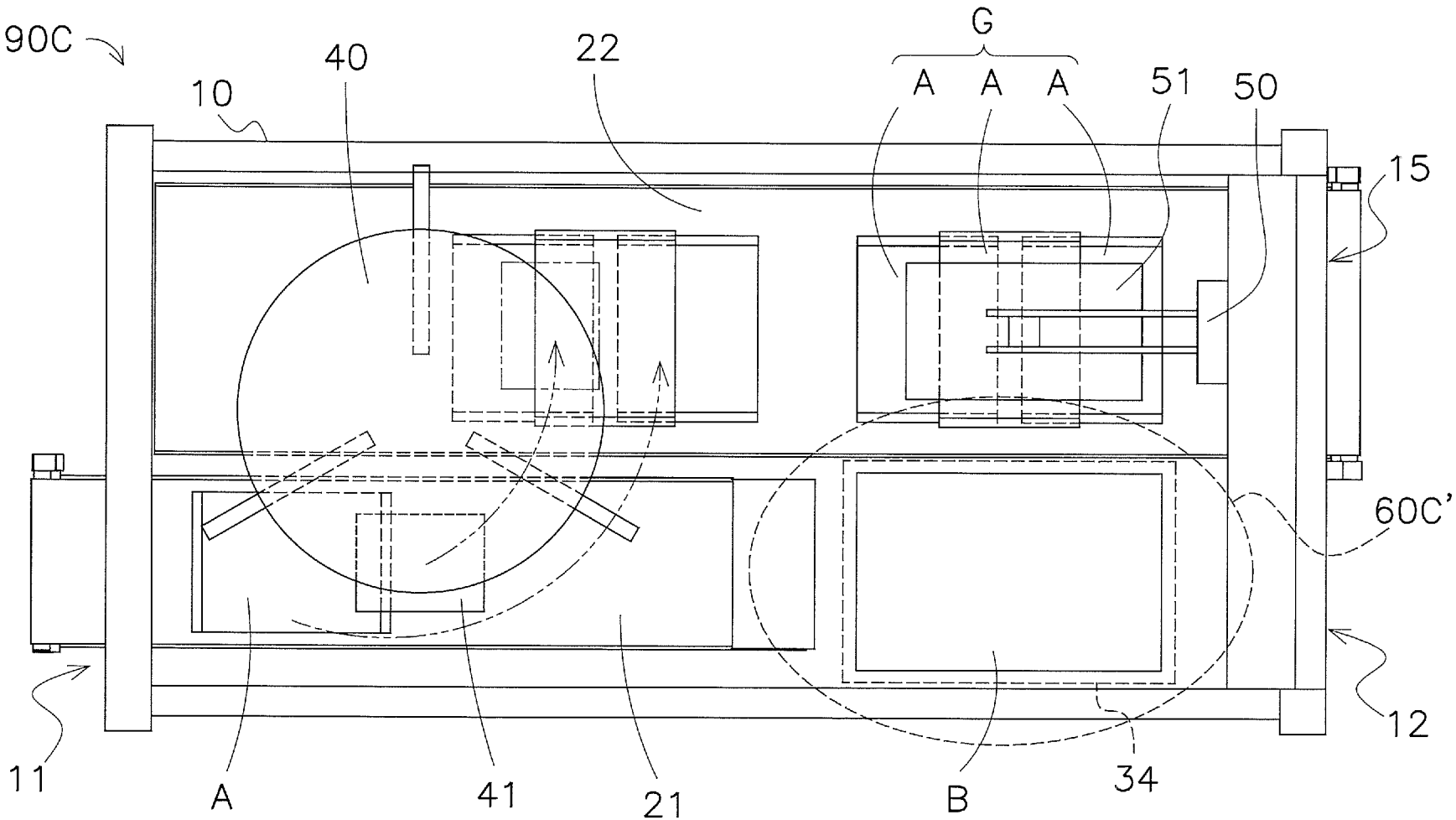
FIG. 11 is a plan view of a box packing apparatus 90C pertaining to a fourth embodiment of the invention.

A detection unit 60C of a box packing apparatus 90C pertaining to a fourth embodiment of the invention is configured from a camera as in the first embodiment. The detection unit 60C captures an image of an area including a target region 60C' shown in FIG. 11. The target region 60' includes the packing station 34. The image signals captured by the detection unit 60C are sent to the signal processing unit 84 of the control unit 80 of FIG. 5. The signal processing unit 84 performs image processing such as binarization and edge extraction on the image signals to thereby detect the shape of the area occupied by the article group G Next, the determination unit 85 compares the shape of the article group G to the size of the packing box B to determine whether or not the posture of the article group G is normal or abnormal.

Moreover, the signal processing unit 84 analyzes the image on the outer side of the packing box B to detect the presence of an article A that has fallen outside the packing box B. In a case where there is an article A that has fallen outside the packing box B, the determination unit 85 determines that the posture of the article group G is abnormal.

In a case where the determination unit 85 has determined that the posture of the article group G is abnormal, the actuator driving unit 83 drives the second conveyor 22 to discharge the improper article group G from the discharge area 15 to the outside of the box packing apparatus 90.

(2) Characteristics

The detection result of the detection unit 60C relates to the posture of the article group G that has undergone packing. Consequently, damage to and/or loss of the articles A that has arisen during the packing can be detected.

(3) Example Modifications

The example modifications of the embodiments up to now can also be applied to this embodiment.

Fifth Embodiment (1) Configuration

Figure 12:
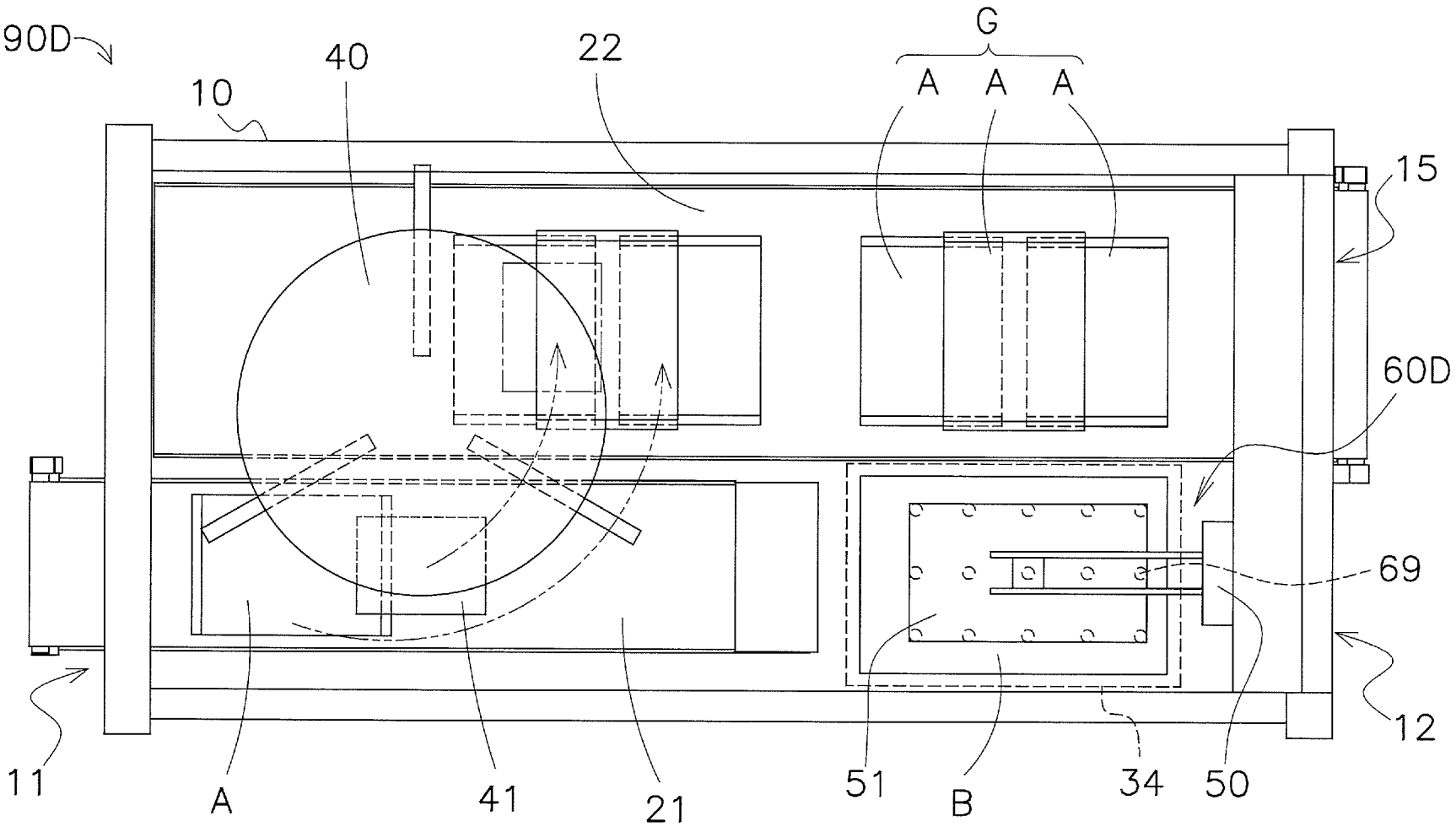
FIG. 12 is a plan view of a box packing apparatus 90D pertaining to a fifth embodiment of the invention.

FIG. 12 shows a detection unit 60D of a box packing apparatus 90D pertaining to a fifth embodiment of the invention. The box packing apparatus 90D differs from the box packing apparatus 90 pertaining to the first embodiment in that it has the detection unit 60D instead of the detection unit 60.

The detection unit 60D comprises multiple photosensors 69. As in the second embodiment, the photosensors 69 are all reflective photosensors. The photosensors 69 are provided between adjacent contactors 52 on the undersurface of the head 51 of the packing mechanism 50. Light emitting components of the photosensors 69 emit light downward. The light reflects off the article group G that is a target object. Light receiving components detect the reflected light.

After the packing mechanism 50 has packed the article group G into the packing box B, the head 51 moves to a predetermined height away from the packing box B. Thereafter, the multiple photosensors 69 of the detection unit 60D measure the levels of the reflected light.

The signal processing unit 84 of FIG. 5 grasps the detection levels of the photosensors 69. The determination unit 85 compares the detection levels of the multiple photosensors 69 to each other to check whether the heights of various places of the article group G that has been packed are uniform. If the heights are ununiform, the determination unit 85 determines that the posture of the article group G is abnormal. The determination unit 85 secondly checks whether the magnitudes of the detection levels are appropriate on the basis of the number of tiers of the article groups G that have already been packed into the packing box B. If the magnitudes of the detection levels are not appropriate, the determination unit 85 determines that the posture of the article group G is abnormal.

(2) Characteristics

The detection result relates to the posture of the article group G that has undergone packing. Consequently, damage to and/or loss of the articles A that has arisen during the packing can be detected.

(3) Example Modifications

The example modifications of the embodiments up to now can also be applied to this embodiment.

Sixth Embodiment (1) Configuration

Figure 13:
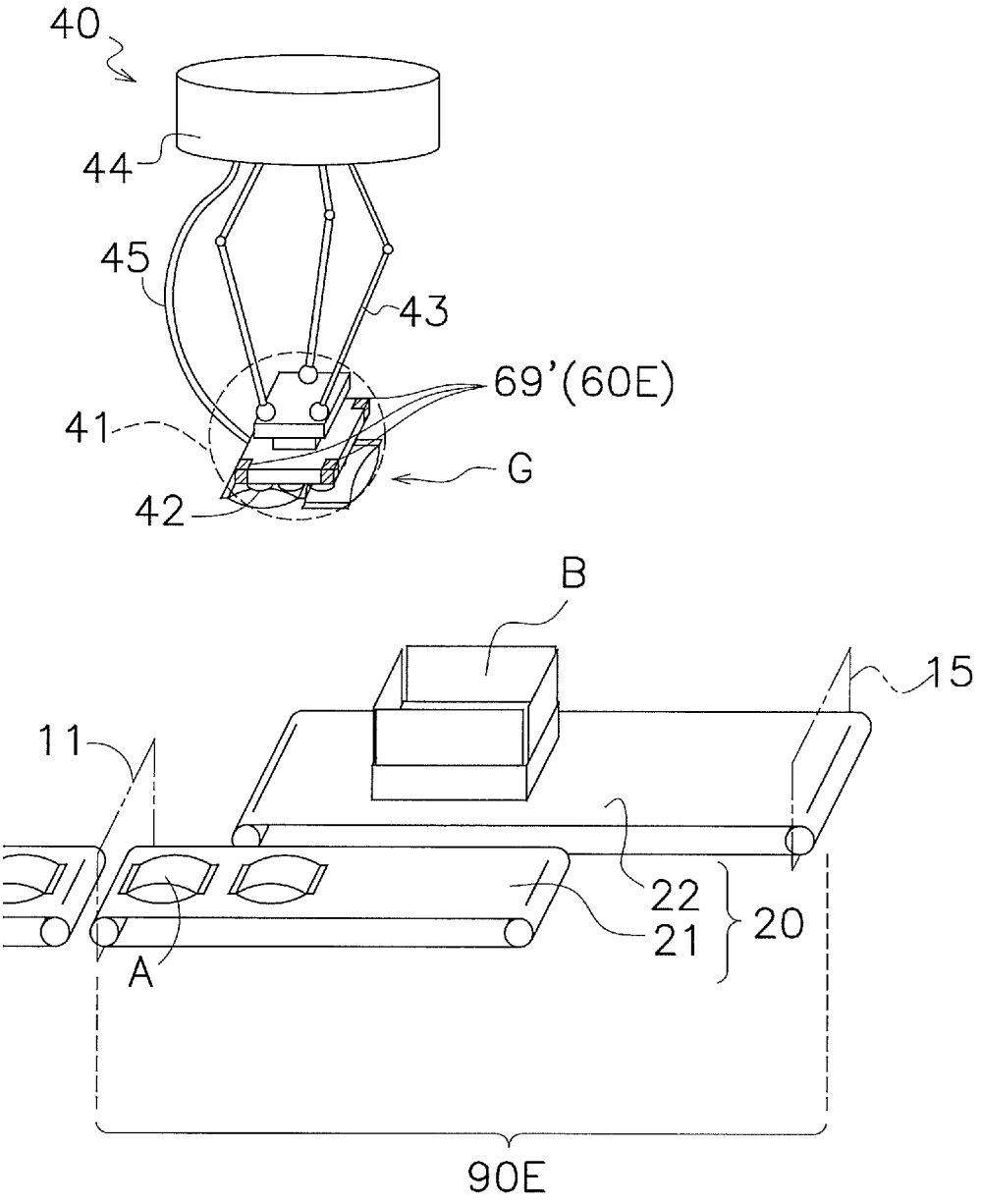
FIG. 13 is a schematic view of the internal configuration of a box packing apparatus 90E pertaining to a sixth embodiment of the invention.

FIG. 13 shows a box packing apparatus 90E pertaining to a sixth embodiment of the invention. The box packing apparatus 90E differs from the box packing apparatus 90 pertaining to the first embodiment in that the accumulating mechanism 40 combines the functions of the packing mechanism 50 and a detection unit 60E.

The accumulating mechanism 40 first picks up one article A from the first conveyor 21. The accumulating mechanism 40 next picks up a second article A from the first conveyor 21 without placing the first article A on the second conveyor 22. The accumulating mechanism 40 next picks up a third article A from the first conveyor 21 while retaining the first article A and the second article A. In this way, the accumulating mechanism 40 creates an article group G from a plurality of the articles A.

Photosensors 69' are provided in the head 41 of the accumulating mechanism 40. The photosensors 69' configure the detection unit 60E. As in the second embodiment, the photosensors 69' are all reflective photosensors. Light emitting components of the photosensors 69' emit light downward. The light reflects on the article group G that is a target object. Light receiving components detect the reflected light. The posture or state of the article group G is grasped by the levels of the reflected light detected by the light receiving components.

An empty packing box B stands by on the second conveyor 22. The accumulating mechanism 40 packs the article group G into the packing box B. The packing box B that has finished being packed is discharged from the discharge area 15 by the second conveyor 22.

(2) Characteristics

The accumulating mechanism 40 combines the functions of the packing mechanism 50 and the detection unit 60E. Consequently, the packing device 90E is configured inexpensively.

(3) Example Modifications

The example modifications of the embodiments up to now can also be applied to this embodiment.

REFERENCE SIGNS LIST

10: Frame
11: Inlet Area
12: Outlet Area
20: Article Conveyance Unit
21: First Conveyor
22: Second Conveyor
30: Box Conveyance Unit
33: Third Conveyor
34: Packing Station
40: Accumulating Mechanism
50: Packing Mechanism
51: Head
52: Contactors
53: Rod
54: Vertical Moving Device
55: Horizontal Moving Device
56: Hose
60, 60A to E: Detection Units
61*a* to *d*: Photosensors
65*a*, 65*b*, 66*a*, 66*b*: Photosensors
67*a*, 67*b*, 68*a*, 68*b*: Photosensors
69, 69': Photosensors
70: Box Retention Unit
75: Determination Unit
80: Control Unit
81: Central Processing Unit
82: Sensor Reading Unit
83: Actuator Driving Unit
84: Signal Processing Unit
85: Determination Unit
90, 90A to E: Box Packing Apparatus
A: Articles
B: Packing Box
C: Creases
FL: Lower Flaps
FU: Upper Flaps
G: Article Group
W: Wall Portions

The invention claimed is:

1. A box packing apparatus comprising:

an accumulating mechanism configured to accumulate a plurality of articles to create an article group;

an article group placement unit on which the article group created by the accumulating mechanism is placed;

a detection unit configured to detect a posture of the article group;

a determination unit configured to compare the posture of the article group to a size of a packing box to determine whether the posture of the article group is normal or abnormal based on an output of the detection unit; and a packing mechanism configured to pack the article group into the packing box based on a determination result of the determination unit, wherein the packing mechanism has a gripping unit that grips en bloc the article group, and the detection unit is further configured to detect the posture of the article group being gripped by the gripping unit, or the posture of the article group placed on the article group placement unit.

2. The box packing apparatus according to claim 1, wherein the detection unit is further configured to detect the posture of the article group after the article group has undergone packing into the packing box by the packing mechanism.

3. The box packing apparatus according to claim 1, wherein the detection unit has a camera.

4. The box packing apparatus according to claim 1, wherein the detection unit has a photosensor.

5. The box packing apparatus according to claim 1, wherein the detection unit has a photosensor provided in the gripping unit.

6. The box packing apparatus according to claim 1, further comprising a box retention unit configured to retain at least part of the packing box, wherein the detection unit has photosensors provided in the box retention unit.

7. The box packing apparatus according to claim 1, wherein in a case where the determination unit has determined that the posture of the article group is abnormal, the packing mechanism discharges the article group without packing it into the packing box.

8. The box packing apparatus according to claim 1, wherein the accumulating mechanism is further configured to create the article group by gripping the plurality of articles.

9. The box packing apparatus according to claim 8, wherein the accumulating mechanism has a suction head for gripping the article group.

10. The box packing apparatus according to claim 8, wherein the detection unit is installed in the accumulating mechanism and configured to detect the posture of the article group gripped by the accumulating mechanism.

11. The box packing apparatus according to claim 8, wherein the accumulating mechanism and the packing mechanism are configured by the same robot.

12. The box packing apparatus according to claim 11, wherein in a case where the determination unit has determined that the posture of the article group is abnormal, the packing mechanism discharges the article group without packing it into the packing box.

* * * * *